US006003005A

United States Patent [19]

Hirschberg

[11] Patent Number: 6,003,005

[45] **Date of Patent: *Dec. 14, 1999**

[54] TEXT-TO-SPEECH SYSTEM AND A METHOD AND APPARATUS FOR TRAINING THE SAME BASED UPON INTONATIONAL FEATURE ANNOTATIONS OF INPUT TEXT

[75] Inventor: Julia Hirschberg, Cranford, N.J.

[73] Assignee: Lucent Technologies, Inc., Murray Hill, N.J.

[ * ] Notice: This patent is subject to a terminal disclaimer.

[21] Appl. No.: 08/978,359

[22] Filed: Nov. 25, 1997

Related U.S. Application Data

[63] Continuation of application No. 08/548,794, Nov. 2, 1995, which is a continuation of application No. 08/138,577, Oct. 15, 1993, abandoned.

[51] Int. Cl.[6] ..... G10L 5/00

[52] U.S. Cl. ..... 704/260

[58] Field of Search ..... 704/200, 260, 704/259, 256, 258, 270, 272

[56] References Cited

U.S. PATENT DOCUMENTS

| | | | |
|---|---|---|---|
| 4,829,580 | 5/1989 | Church | 704/260 |
| 4,979,216 | 12/1990 | Malsheen et al. | 381/52 |
| 5,075,896 | 12/1991 | Wilcox et al. | 382/39 |
| 5,146,405 | 9/1992 | Church | 364/419 |
| 5,212,730 | 5/1993 | Wheatley et al. | 381/43 |
| 5,230,037 | 7/1993 | Giustiniani et al. | 395/2 |
| 5,267,345 | 11/1993 | Brown et al. | 395/2.64 |
| 5,774,854 | 6/1998 | Sharman | 704/260 |
| 5,796,916 | 8/1998 | Meredith | 704/258 |
| 5,890,117 | 3/1999 | Silverman | 704/260 |

OTHER PUBLICATIONS

Computer Speech and Language. Wnag et al. "Automatic classification of intonational phrase boundaries". vol. 6, No. 2, pp. 175–196, Apr. 1992.

Eurospeech 91. Hirshchberg, "Using text analysis to predict intonational boundaries", pp. 1275–1278, Sep. 1991.

M.Q. Wang et al., "Predicting Intonational Boundaries Automatically From Text: The ATIS Domain," (DARPA 1991) pp. 378–383.

R. Sproat et al., "A Corpus–Based Synthesizer," pp. 563–566. No date.

M.Q. Wang et al., "Automatic Classification of Intonational Phrase Boundaries," *Computer Speech and Language*, vol. 6, 1992, pp. 175–196.

N.M. Veilleux et al., "Markov Modeling Of Prosodic Phrase Structure," *IEEE*, 1990, pp. 777–780.

E. Brill et al., "Deducing Linguistic Structure From the Statistics Of Large Corpora," *IEEE*, 1990, pp. 380–389.

*Primary Examiner*—Richemond Dorvil

*Attorney, Agent, or Firm*—Dickstein Shapiro Morin & Oshinsky LLP

[57] ABSTRACT

A method of training a TTS or other system to assign intonational features, such as intonational phrase boundaries, to input text that overcome the shortcomings of the known methods is described. The method of training involves taking a set of predetermined text (not speech or a signal representative of speech) and having a human annotate it with intonational feature annotations. This results in annotated text. Next, the structure of the set of predetermined text is analyzed to generate information. This information is used, along with the intonational feature annotations, to generate a statistical representation. The statistical representation may then be stored and repeatedly used to generate synthesized speech from new sets of input text without training the TTS system further. The resulting trained system and use thereof are also part of the invention.

30 Claims, 2 Drawing Sheets

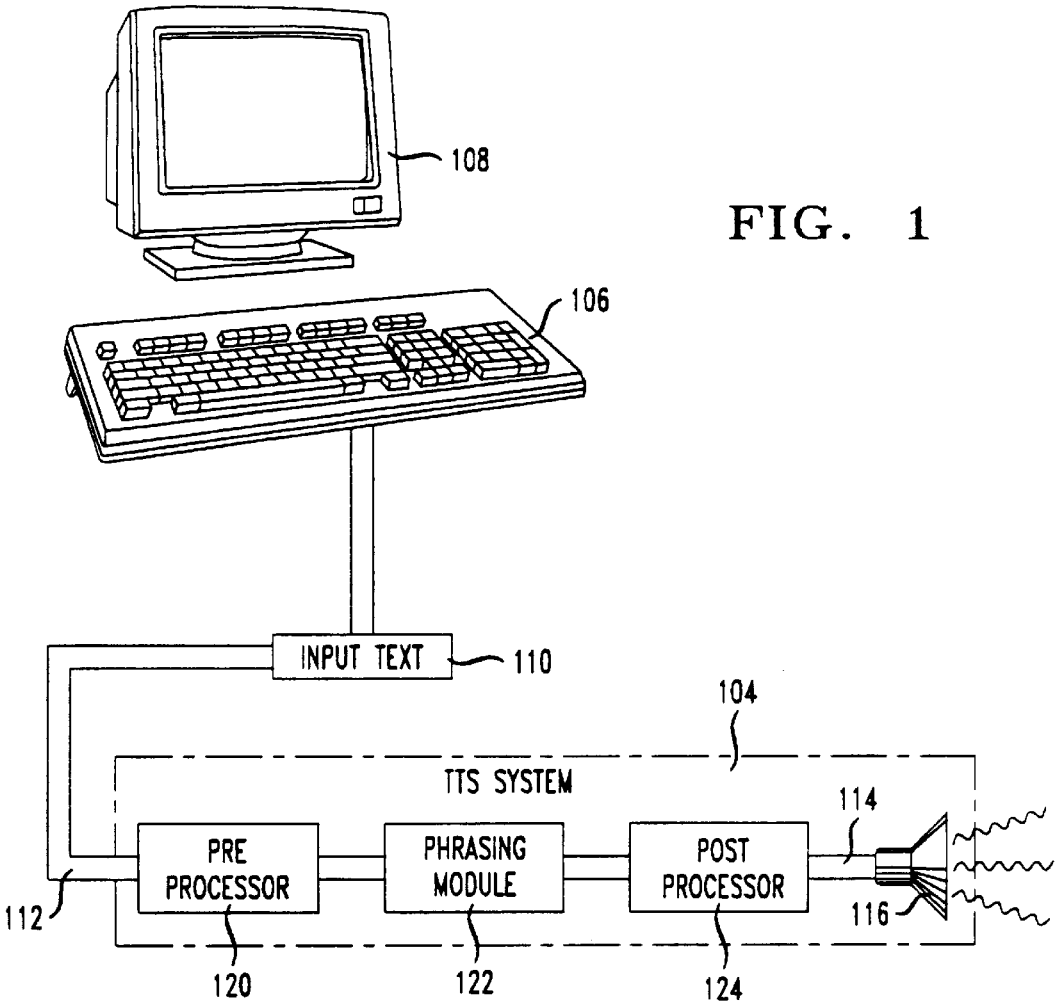
FIG. 1
FIG. 3
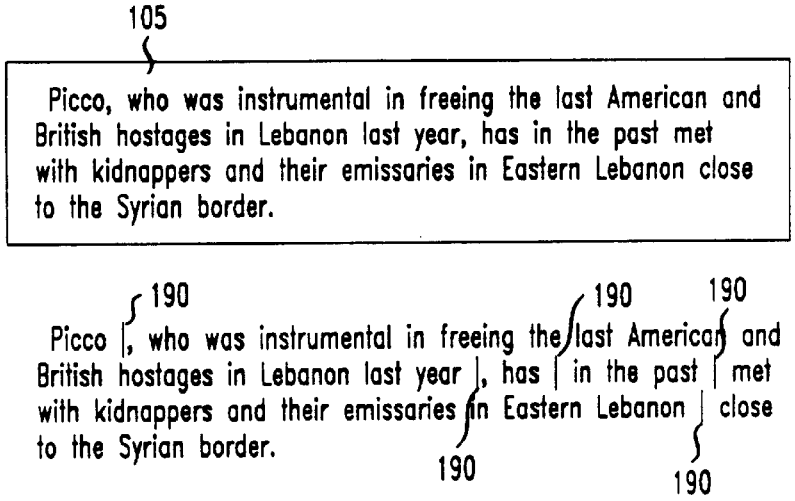

TEXT-TO-SPEECH SYSTEM AND A METHOD AND APPARATUS FOR TRAINING THE SAME BASED UPON INTONATIONAL FEATURE ANNOTATIONS OF INPUT TEXT

This is a continuation of application Ser. No. 08/548,794 filed Nov. 02, 1995 which is a continuation of Ser. No. 08/138,577 filed Oct. 15, 1993, now abandoned.

FIELD OF THE INVENTION

The present invention relates to methods and systems for converting text-to-speech ("TTS"). The present invention also relates to the training of TTS systems.

BACKGROUND OF THE INVENTION

In using a typical TTS system, a person inputs text, for example, via a computer system. The text is transmitted to the TTS system. Next, the TTS system analyzes the text and generates a synthesized speech signal that is transmitted to an acoustic output device. The acoustic output device outputs the synthesized speech signal.

The creation of the generated speech of TTS systems has focused on two characteristics, namely intelligibility and naturalness. Intelligibility relates to whether a listener can understand the speech produced (i.e., does "dog" really sound like "dog" when it is generated or does it sound like "dock"). However, just as important as intelligibility is the human-like quality, or naturalness, of the generated speech. In fact, it has been demonstrated that unnaturalness can affect intelligibility.

Previously, many have attempted to generate natural sounding speech with TTS systems. These attempts to generate natural sounding speech addressed a variety of issues.

One of these issues is the need to assign appropriate intonation to the speech. Intonation includes such intonational features, or "variations," as intonational prominence, pitch range, intonational contour, and intonational phrasing. Intonational phrasing, in particular, is "chunking" of words in a sentence into meaningful units separated by pauses, the latter being referred to as intonational phrase boundaries. Assigning intonational phrase boundaries to the text involves determining, for each pair of adjacent words, whether one should insert an intonational phrase boundary between them. Depending upon where intonational phrase boundaries are inserted into the candidate areas, the speech generated by a TTS system may sound very natural or very unnatural.

Known methods of assigning intonational phrase boundaries are disadvantageous for several reasons. Developing a model is very time consuming. Further, after investing much time to generate a model, the methods that use the model simply are not accurate enough (i.e., they insert a pause where one should not be present and/or they do not insert a pause where one should be present) to generate natural sounding synthesized speech.

The pauses and other intonational variations in human speech often have great bearing on the meaning of the speech and are, thus, quite important. For example, with respect to intonational phrasing, the sentence "The child isn't screaming because he is sick" spoken as a single intonational phrase may lead the listener to infer that the child is, in fact, screaming, but not because he is sick. However, if the same sentence is spoken as two intonational phrases with an intonational phrase boundary between "screaming" and "because," (i.e., "The child isn't screaming, because he is sick") the listener is likely to infer that the child is not screaming, and the reason is that he is sick.

Assigning intonational phrasing has previously been carried out using one of at least five methods. The first four methods have an accuracy of about 65 to 75 percent when tested against human performance (e.g., where a speaker would have paused/not paused). The fifth method has a higher degree of accuracy than the first four methods (about 90 percent) but takes a long time to carry out the analysis.

A first method is to assign intonational phrase boundaries in all places where the input text contains punctuation internal to a sentence (i.e., a comma, colon, or semi-colon, but not a period). This method has many shortcomings. For example, not every punctuation internal to the sentence should be assigned an intonational phrase boundary. Thus, there should not be an intonational phrase boundary between "Rock" and "Arkansas" in the phrase "Little Rock, Ark." Another shortcoming is that when speech is read by a person, the person typically assigns intonational phrase boundaries to places other than internal punctuation marks in the speech.

A second method is to assign intonational phrase boundaries before or after certain key words such as "and," "today," "now," "when," "that," or "but." For example, if the word "and" is used to join two independent clauses (e.g. "I like apples and I like oranges"), assignment of an intonational phrase boundary (e.g., between "apples" and "and") is often appropriate. However, if the word "and" is used to join two nouns (e.g., "I like apples and oranges"), assignment of an intonational phrase boundary (e.g., between "apples" and "and") is often inappropriate. Further, in a sentence like "I take the 'nuts and bolts' approach," the assignment of an intonational phrase boundary between "nuts" and "and" would clearly be inappropriate.

A third method combines the first two methods. The shortcomings of these types of methods are apparent from the examples cited above.

A fourth method has been used primarily for the assignment of intonational phrase boundaries for TTS systems whose input is restricted by its application or domain (e.g., names and addresses, stock market quotes, etc . . . ). This method has generally involved using a sentence or syntactic parser, the goal of which is to break up a sentence into subjects, verbs, objects, complements, etc . . . Syntactic parsers have shortcomings for use in the assignment of intonational phrase boundaries in that the relationship between intonational phrase boundaries and syntactic structure has yet to be clearly established. Therefore, this method often assigns phrase boundaries incorrectly. Another shortcoming of syntactic parsers is their speed (or lack thereof), or inability to run in real time. A further shortcoming is the amount of memory needed for their use. Syntactic parsers have yet to be successfully used in unrestricted TTS systems because of the above shortcomings. Further, in restricted-domain TTS systems, syntactic parsers fail particularly on unfamiliar input and are difficult to extend to new input and new domains.

A fifth method that could be used to assign intonational phrase boundaries would increase the accuracy of appropriately assigning intonational phrase boundaries to about 90 percent. This is described in Wang and Hirschberg, "Automatic classification of intonational phrase boundaries," Computer Speech and Language, vol. 6, pages 175–196 (1992). The method involves having a speaker read a body of text into a microphone and recording it. The recorded speech is then prosodically labelled. Prosodically labeling speech entails identifying the intonational features of speech that one desires to model in the generated speech produced by the TTS system.

This method also has significant drawbacks. It is expensive because it usually entails the hiring of a professional speaker. A great amount of time is necessary to prosodically label recorded speech, usually about one minute for each second of recorded speech and even then only if the labelers are very experienced. Moreover, since the process is time-consuming and expensive, it is difficult to adapt this process to different languages, different applications, different speaking styles.

More specifically, a particular implementation of the last-mentioned method used about 45 to 60 minutes of natural speech that was then prosodically labeled. Sixty minutes of speech takes about 60 hours (e.g., 3600 minutes) just for prosodic labeling the speech. Additionally, there is much time required to record the speech and process the data for analysis (e.g., dividing the recorded data into sentences, filtering the sentences, etc . . . ). This usually takes about 40 to 50 hours. Also, the above assumes that the prosodic labeler has been trained; training often takes weeks, or even months.

SUMMARY OF THE INVENTION

We have discovered a method of training a TTS or other system to assign intonational features, such as intonational phrase boundaries, to input text that overcomes the shortcomings of the known methods. The method of training involves taking a set of predetermined text (not speech or a signal representative of speech) and having a human annotate it with intonational feature annotations (e.g., intonational phrase boundaries). This results in annotated text. Next, the structure of the set of predetermined text is analyzed—illustratively, by answering a set of text-oriented queries—to generate information which is used, along with the intonational feature annotations, to generate a statistical representation. The statistical representation may then be repeatedly used to generate synthesized speech from new sets of input text without training the TTS system further.

Advantageously, the invention improves the speed in which one can train a system that assigns intonational features, thereby also serving to increase the adaptability of the invention to different languages, dialects, applications, etc.

Also advantageously, the trained system achieves about 95 percent accuracy in assigning one type of intonational feature, namely intonational phrase boundaries, when measured against human performance.

BRIEF DESCRIPTION OF THE DRAWINGS

FIG. 1 shows a TTS system;

FIG. 3 shows a set of predetermined text having intonational feature annotations inserted therein.

DETAILED DESCRIPTION

Figure 2:
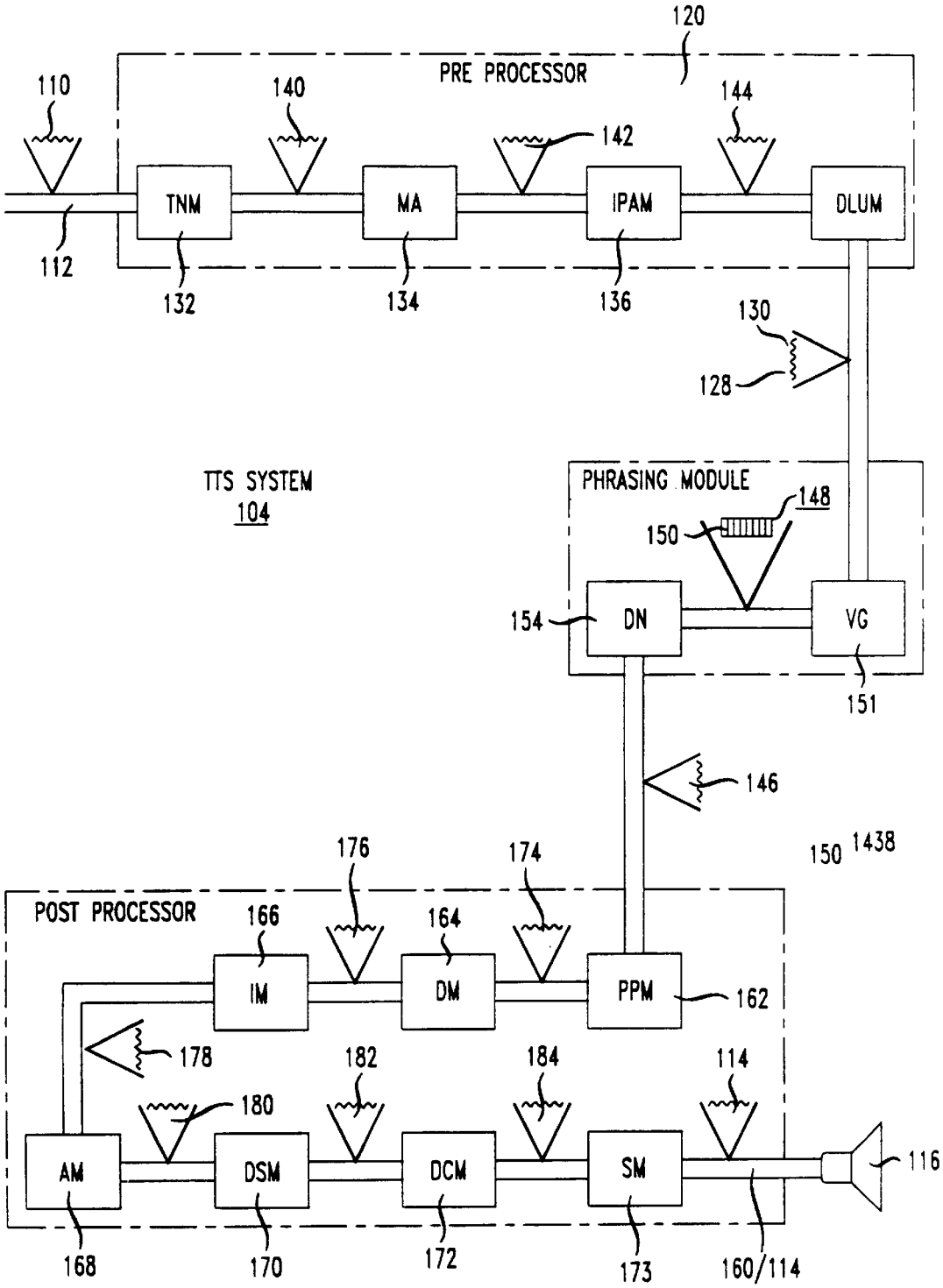
FIG. 2 shows a more detailed view of the TTS system.

FIG. 1 shows a TTS system 104. A person inputs, for example via a keyboard 106 of a computer 108, input text 110. The input text 110 is transmitted to the TTS system 104 via communications line 112. The TTS system 104 analyzes the input text 110 and generates a synthesized speech signal 114 that is transmitted to a loudspeaker 116. The loudspeaker 116 outputs a speech signal 118.

FIG. 2 shows, in more detail, the TTS system 104. The TTS system is comprised of four blocks, namely a pre-processor 120, a phrasing module 122, a post-processor 124, and an acoustic output device 126 (e.g., telephone, loudspeaker, headphones, etc . . . ). The pre-processor 120 receives as its input from communications line 112 the input text 110. The pre-processor takes the input text 110 and outputs a linked list of record structures 128 corresponding to the input text. The linked list of record structures 128 (hereinafter "records 128") comprises representations of words in the input text 110 and data regarding those words ascertained from text analysis. The records 128 are simply a set of ordered data structures. Except for the phrasing module 122, which implements the present invention, the other components of the system are of conventional design. The pre-processor Again referring to FIG. 2, the pre-processor 120, which is of conventional design, is comprised of four sub-blocks, namely, a text normalization module 132, a morphological analyzer 134, an intonational prominence assignment module 136, and a dictionary look-up module 138. These sub-blocks are referred to as "TNM," "MA," "IPAM," and "DLUM," respectively, in FIG. 2. These sub-blocks, which are arranged in a pipeline configuration (as opposed to in parallel), take the input text 110 and generate the records 128 corresponding to the input text 110 and data regarding the input text 110. The last sub-block in the pipeline (dictionary look-up module 138) outputs the records 128 to the phrasing module 122.

The text normalization module 132 of FIG. 2 has as its input the input text 110 from the communications line 112. The output of the text normalization module 132 is a first intermediate set of records 140 which represents the input text 110 and includes additional data regarding the same. For example, the first intermediate set of records 140 includes, but is not limited to, data regarding:

(1) identification of words, punctuation marks, and explicit commands to the TTS system 104 such as an escape sequence;

(2) interpretation for abbreviations, numbers, etc . . . ; and (3) part of speech tagging based upon the words identified in "(1)" above (i.e., the identification of nouns, verbs, etc . . . ).

The morphological analyzer 134 of FIG. 2 has as its input the first intermediate set of records 140. The output of the morphological analyzer 134 is a second intermediate set of records 142, containing, for example, additional data regarding the lemmas or roots of words (e.g., "child" is the lemma of "children", "go" is the lemma of "went", "cat" is the lemma of "cats", etc . . . ).

The intonational prominence assignment module 136 of FIG. 2 has as its input the second intermediate set of records 142. The output of the intonational prominence assignment module 136 is a third intermediate set of records 144, containing, for example, additional data regarding whether each real word (as opposed to punctuation, etc . . . ) identified by the text normalization module 132 should be made intonationally prominent when eventually generated.

The dictionary look-up module 138 of FIG. 2 has as its input the third intermediate set of records 144. The output of the dictionary look-up module 138 is the records 128. The dictionary look-up module 138 adds to the third intermediate set of records 144 additional data regarding, for example, how each real word identified by the text normalization module 132 should be pronounced (e.g., how do you pronounce the word "bass") and what its component parts are (e.g., phonemes and syllables).

The phrasing module

The phrasing module 122 of FIG. 2 embodying the invention, has as its input the records 128. The phrasing module 122 outputs a new linked list of record structures 146 containing additional data including but not limited to a new record for each intonational boundary assigned by the phrasing module 122. The phrasing module determines, for each potential intonational phrase boundary site (i.e., positions between two real words), whether or not to assign an intonational phrase boundary at that site. This determination is based upon a vector 148 associated with each individual site. Each site's vector 148 comprises a set of variable values 150. For example, for each potential intonational phrase boundary site $<w_i, w_j>$ (wherein $w_i$ and $w_j$ represent real words to the left and right, respectively, of the potential intonational phrase boundary site) one may ask the following set of text-oriented queries to generate the site's vector 148:

(1) is $w_i$ intonationally prominent and if not, is it further reduced (i.e., cliticized)?;
(2) is $w_j$ intonationally prominent and if not, is it further reduced (i.e., cliticized)?;
(3) what is the part of speech of $w_i$?;
(4) what is the part of speech of $w_{i-1}$?;
(5) what is the part of speech of $w_j$?;
(6) what is the part of speech of $w_{j+1}$?;
(7) how many words are in the current sentence?;
(8) what is the distance, in real words, from $w_j$ to the beginning of the sentence?;
(9) what is the distance, in real words, from $w_j$ to the end of the sentence?;
(10) what is the location (e.g., immediately before, immediately after, within, between two noun phrases, or none of the above) of the potential intonational boundary site with respect to the nearest noun phrase?;
(11) if the potential intonational phrase boundary site is within a noun phrase, how far is it from the beginning of the noun phrase (in real words)?;
(12) what is the size, in real words, of the current noun phrase (defaults to zero if $w_j$ is not within a noun phrase)?;
(13) how far into the noun phrase is $w_j$ (i.e., if $w_j$ is within a noun phrase, divide "(11)" above by "(12)" above, otherwise this defaults to zero)?;
(14) how many syllables precede the potential intonational boundary site in the current sentence?;
(15) how many strong (lexically stressed) syllables precede the potential intonational boundary site in the current sentence?;
(16) what is the total number of strong syllables in the current sentence?;
(17) what is the stress level (i.e., primary, secondary, or unstressed) of the syllable immediately preceding the potential intonational boundary site?;
(18) what is the result when one divides the distance from $w_j$ to the last intonational boundary assigned, by the total length of the last intonational phrase?;
(19) is there punctuation (e.g., comma, dash, etc . . . ) at the potential intonational boundary site?; and
(20) how many primary or secondary stressed syllables exist between the potential intonational boundary site and the beginning of the current sentence.

The variable values corresponding to the answers to the above 20 questions are encoded into the site's vector 148 in a vector generator 151 (referred to as "VG" in FIG. 2). An vector 148 is formed for each site. The vectors 148 are sent, in serial fashion, to a set of decision nodes 152. Ultimately, the set of decision nodes 152 provide an indication of whether or not each potential intonational phrase boundary site should or should not be assigned as an intonational phrase boundary. The set of above twenty questions are asked because the set of decision nodes 152 was generated by applying the same set of 20 text-oriented queries to a set of annotated text in accordance with the invention. Preferably, the set of decision nodes 152 comprises a decision tree 154. Preferably, the decision tree has been generated using classification and regression tree ("CART") techniques that are known as explained in Brieman, Olshen, and Stone, Classification and Regression Trees, Wadsworth & Brooks, Monterey, Calif. (1984).

It should be noted that the above set of queries comprises text-oriented queries and is currently the preferred set of queries to ask. However, those skilled in the art will realize that subsets of the above set of queries, different queries, and/or additional queries may be asked that obtain satisfactory results. For example, instead of asking queries relating to part-of-speech of words in the sentence (as in (3) through (6) above), queries relating to the syntactic constituent structure of the input text or co-occurrence statistics regarding adjacent words in the input text may be asked to obtain similar results. The queries relating syntactic constituent structure focus upon the relationship of the potential intonational phrase boundary to the syntactic constituents of the current sentence (e.g., does the potential intonational phrase boundary occur between a noun phrase and a verb phrase?). The queries relating co-occurrence focus upon the likelihood of two words within the input text appearing close to each other or next to each other (e.g., how frequently does the word "cat" co-occur with the word "walk").

The post-processor

Again referring to FIG. 2, post-processor 124, which is of conventional design, has as its input the new linked list of records 146. The output of the post-processor is a synthesized speech signal 114. The post-processor has seven sub-blocks, namely, a phrasal phonology module 162, a duration module 164, an intonation module 166, an amplitude module 168, a dyad selection module 170, a dyad concatenation module 172, and a synthesizer module 173. These sub-blocks are referred to as "PPM," "DM," "IM," "AM," "DSM," "DCM," and "SM," respectively, in FIG. 2. The above seven modules address, in a serial fashion, how to realize the new linked list of records 146 in speech.

The phrasal phonology module 162 takes the new linked list of records 146. The phrasal phonology module outputs a fourth intermediate set of records 174 containing, for example, what tones to use for phrase accents, pitch accents, and boundary tones and what prominences to associate with each of these tones. The above terms are described in Pierrehumbert, The Phonology and Phonetics of English Intonation, (1980) M. I. T. Ph. D. Thesis.

The duration module 164 takes the fourth intermediate set of records 174 as its input. This module outputs a fifth set of intermediate records 176 containing, for example, the duration of each phoneme that will be used to realize the input text 110 (e.g., in the sentence "The cat is happy" this determines how long the phoneme "/p/" will be in "happy").

The intonation module 166 takes the fifth set of records 176 as its input. This module outputs a sixth set of intermediate records 178 containing, for example, the fundamental frequency contour (pitch contour) for the current sentence (e.g., whether the sentence "The cat is happy" will be generated with falling or rising intonation).

The amplitude module 168 takes the sixth set of records 178 as its input. This module outputs a seventh set of intermediate records 180 containing, for example, the amplitude contour for the current sentence (i.e., how loud each portion of the current sentence will be).

The dyad selection module 170 takes the seventh set of records 180 as its input. This module outputs a eighth set of intermediate records 182 containing, for example, a list of which concatenative units (i.e., transitions from one phoneme to the next phoneme) should be used to realize the speech.

The dyad concatenation module 172 takes the eighth set of records 182 as its input. This module outputs a set of linear predictive coding reflection coefficients 184 representative of the desired synthetic speech signal.

The synthesizer module 173 takes the set of linear predictive coding reflection coefficients 184 as its input. This module outputs the synthetic speech signal to the acoustic output device 126.

Training the system

The training of TTS system 104 will now be described in accordance with the principles of the present invention.

The training method involves annotating a set of predetermined text 105 with intonational feature annotations to generate annotated text. Next, based upon structure of the set of predetermined text 105, information is generated. Finally, a statistical representation is generated that is a function of the information and the intonational feature annotations.

Referring to FIG. 3, an example of the set of predetermined text 105 is shown separately and then is shown as "annotated text." The symbols '|', designated by reference numerals 190, are used to denote 'predicted intonational boundary.' In practice, much more text than the amount shown in FIG. 3 will likely be required to train a TTS system 104. Next, the set of predetermined text 105 is passed through the pre-processor 120 and the phrasing module 122, the latter module being the module wherein, for example, a set of decision nodes 152 is generated by statistically analyzing information. More specifically, the information (e.g., information set) that is statistically analyzed is based upon the structure of the set of predetermined text 105. Next, a statistical analysis may be done by using CART techniques, as described above. This results in the statistical representation (e.g., the set of decision nodes 152). The set of decision nodes 152 takes the form of a decision tree. However, those skilled in the art will realize that the set of decision nodes could be replaced with a number of statistical analyses including, but not limited to, hidden Markov models and neural networks.

The statistical representation (e.g., the set of decision nodes 152) may then be repeatedly used to generate synthesized speech from new sets of text without training the TTS system further. More specifically, the set of decision nodes 152 has a plurality of paths therethrough. Each path in the Plurality of paths terminates in an intonational feature assignment predictor that instructs the TTS system to either insert or not insert an intonational feature at the current potential intonational feature boundary site. The synthesized speech contains intonational features inserted by the TTS system. These intonational features enhance the naturalness of the sound that emanates from the acoustic output device, the input of which is the synthesized speech.

The training mode can be entered into by simply setting a "flag" within the system. If the system is in the training mode, the phrasing module 122 is run in its "training" mode as opposed to its "synthesis" mode as described above with reference to FIGS. 1 and 2. In the training mode, the set of decision nodes 152 is never accessed by the phrasing module 122. Indeed, the object of the training mode is to, in fact, generate the set of decision nodes 152.

It will be appreciated by those skilled in the art that given different sets annotated text will result in different sets of decision nodes. For example, fictional text might be annotated in quite a different manner by the human annotator than scientific, poetic, or other types of text.

The invention has been described with respect to a TTS system. However, those skilled in the art will realize that the invention, which is defined in the claims below, may be applied in a variety of manners. For example, the invention, as applied to a TTS system, could be one for either restricted or unrestricted input. Also, the invention, as applied to a TTS system, could differentiate between major and minor phrase boundaries or other levels of phrasing. Further, the invention may be applied to a speech recognition system. Additionally, the invention may be applied to other intonational variations in both TTS and speech recognition systems. Finally, those skilled in the art will realize that the sub-blocks of both the preprocessor and post-processor are merely important in that they gather and produce data and that the order in which this data is gathered and produced is not tantamount to the present invention (e.g., one could switch the order of sub-blocks, combine sub-blocks, break the sub-blocks into sub-sub-blocks, etc . . . ). Although the system described herein is a TTS system, those skilled in the art will realize that the phrasing module of the present invention may be used in other systems such as speech recognition systems. Further, the the above description focuses on an evaluation of whether to insert an intonational phrase boundary in each potential intonational phrase boundary site. However, those skilled in the art will realize that the invention may be used with other types of potential intonational feature sites.

What I claim is:

1. A machine implemented method of training a system for converting between text and speech, said method comprising the steps of (a) annotating a set of predetermined text with intonational feature annotations to generate annotated text, said set of predetermined text and said annotated text having a physically tangible readable form;

(b) generating a set of structural information regarding said set of predetermined text;

(c) generating a statistical representation of intonational feature information, the statistical representation being a function of said set of structural information and said intonational feature annotations; and (d) storing said statistical representation in said system for use by said system in converting between speech and text.

2. The method of claim 1 wherein the step of annotating comprises prosodically annotating the set of predetermined text with expected intonational features.

3. The method of claim 1 wherein the system is a text-to-speech system.

4. The method of claim 3 wherein the intonational feature annotations comprise intonational phrase boundaries.

5. The method of claim 1 wherein generating a statistical representation comprises generating a set of decision nodes.

6. The method of claim 5 wherein generating the set of decision nodes comprises generating a hidden Markov model.

7. The method of claim 5 wherein generating the set of decision nodes comprises generating a neural network.

8. The method of claim 5 wherein generating the set of decision nodes comprises performing classification and regression tree techniques.

9. The method of claim 1 wherein the steps (a) to (c) are performed on a computer.

10. The method of claim 1 wherein the step of generating a statistical representation of intonational feature information is performed on a phrasing module.

11. An apparatus for converting text to speech, said apparatus comprising:

(a) an input for receiving a set of input text having a physically tangible readable form; and (b) a phrasing module adapted to receive the set of input text from said input, said phrasing module including a stored statistical representation, the stored statistical representation being a function of a set of predetermined text and intonational feature annotations therefor, said phrasing module applying the set of input text to the stored statistical representation to generate an output representative of the set of input text.

12. The apparatus of claim 11 further comprising:

(a) a post processor for processing the output of said phrasing module to generate a synthesized speech signal; and (b) means for applying the synthesized speech signal to an acoustic output device.

13. The apparatus of claim 11 wherein the stored statistical representation comprises a decision tree.

14. The apparatus of claim 11 wherein the stored statistical representation comprises a hidden Markov model.

15. The apparatus of claim 11 wherein the stored statistical representation comprises a neural network.

16. The apparatus of claim 11 wherein said phrasing module comprises a generator, said generator answering a set of stored queries regarding the set of input text, the set of input text comprising a current sentence, the current sentence comprising a beginning, an end, and a plurality of words, each word in the plurality of words being a part of at least one set of words, $w_i$ and $w_j$, wherein $w_i$ and $w_j$ each comprise at least one syllable and each have a part of speech associated therewith and each have a potential noun phrase associated therewith, the potential noun phrase having a beginning and an end, and further wherein $w_i$ and $w_j$ represent real words to the left and right, respectively, of a potential intonational phrase boundary site, $<w_i$ and $w_j>$, and wherein $w_{i-1}$ and $w_{j+1}$ represent real words to the left and right, respectively of $w_i$ and $w_j$, the set of stored queries comprising at least one query selected from the group consisting of (a) is $w_i$ intonationally prominent and if not, is it further reduced?;

(b) is $w_j$ intonationally prominent and if not, is it further reduced?;

(c) what is the part of speech of $w_i$?;

(d) what is the part of speech of $w_{i-1}$,?;

(e) what is the part of speech of $w_j$?;

(f) what is the part of speech of $w_{j+1}$?;

(g) how many words are in the current sentence?;

(h) what is the distance, in real words, from $w_j$ to the beginning of the sentence?;

(i) what is the distance, in real words, from $w_j$ to the end of the sentence?;

(j) what is the location of the potential intonational boundary site with respect to the nearest noun phrase?;

(k) if the potential intonational boundary site is within a noun phrase, how far is it from the beginning of the noun phrase?;

(l) what is the size, in real words, of the current noun phrase?;

(m) how far into the noun phrase is $w_i$?;

(n) how many syllables precede the potential intonational boundary site in the current sentence?;

(o) how many lexically stressed syllables precede the potential intonational boundary site in the current sentence?;

(p) what is the total number of strong syllables in the current sentence?;

(q) what is the stress level of the syllable immediately preceding the potential intonational boundary site?;

(r) what is the result when one divides the distance from $w_j$ to the last intonational boundary assigned by the total length of the last intonational phrase?;

(s) is there punctuation at the potential intonational boundary site?; and (t) how many primary or secondary stressed syllables exist between the potential intonational boundary site and the beginning of the current sentence.

17. A machine implemented method of converting text to speech said method comprising:

(a) accessing a stored statistical representation from a phrasing module, the stored statistical representation being a function of a set of predetermined text and intonational feature annotations therefor; and (b) applying a set of input text having a physically tangible readable form to the stored statistical representation to generate an output representative of the set of input text.

18. The method of claim 17 further comprising:

(a) post-processing the output to generate a synthesized speech signal; and (b) applying the synthesized speech signal to an acoustic output device.

19. The method of claim 17 wherein the stored statistical representation comprises a decision tree.

20. The method of claim 17 wherein the stored statistical representation comprises a hidden Markov model.

21. The method of claim 17 wherein the stored statistical representation comprises a neural network.

22. The method of claim 17 wherein the step of applying comprises answering a set of stored queries regarding the set of input text, the set of input text comprising a current sentence, the current sentence comprising a beginning, an end, and a plurality of words, each word in the plurality of words being a part of at least one set of words, $w_i$ and $w_j$, wherein $w_i$ and $w_j$ each comprise at least one syllable and each have a part of speech associated therewith and each have a potential noun phrase associated therewith, the potential noun phrase having a beginning and an end, and further wherein $w_i$ and $w_j$ represent real words to the left and right, respectively, of a potential intonational phrase boundary site, $<w_i$ and $w_j>$, and wherein $w_{i-1}$ and $w_{j-1}$ represent real words to the left and right, respectively of $w_i$ and w, the set of stored queries comprising at least one query selected from the group consisting of:

(a) is $w_i$ intonationally prominent and if not, is it further reduced?;

(b) is $w_j$ intonationally prominent and if not, is it further reduced?;

(c) what is the part of speech of $w_i$?;

(d) what is the part of speech of $w_{i-1}$?;

(e) what is the part of speech of $w_j$?;

(f) what is the part of speech of $w_{j+1}$?;

(g) how many words are in the current sentence?;

(h) what is the distance, in real words, from $w_j$ to the beginning of the sentence?;

(i) what is the distance, in real words, from $w_j$ to the end of the sentence?;

(j) what is the location of the potential intonational boundary site with respect to the nearest noun phrase?;

(k) if the potential intonational boundary site is within a noun phrase, how far is it from the beginning of the noun phrase?;

(l) what is the size, in real words, of the current noun phrase?;

(m) how far into the noun phrase is $w_i$?;

(n) how many syllables precede the potential intonational boundary site in the current sentence?;

(o) how many lexically stressed syllables precede the potential intonational boundary site in the current sentence?;

(p) what is the total number of strong syllables in the current sentence?;

(q) what is the stress level of the syllable immediately preceding the potential intonational boundary site?;

(r) what is the result when one divides the distance from $w_j$ to the last intonational boundary assigned by the total length of the last intonational phrase?;

(s) is there punctuation at the potential intonational boundary site?; and (t) how many primary or secondary stressed syllables exist between the potential intonational boundary site and the beginning of the current sentence.

23. The method of claim 17 wherein said output is stored on a computer.

24. A machine implemented method of training a text-to-speech system, said method comprising the steps of:

generating a statistical representation, said statistical representation being a function of a set of structural information of a set of text and a set of intonational feature annotations of an annotated version of said set of text; and storing said statistical representation on a text-to-speech system for use ill generating an intonational phrased output for future text input into the system.

25. An apparatus for training a text-to-speech system, said apparatus comprising:

an input for receiving a set of text and an annotated version of the set of text; and a phrasing module adapted to receive the set of text and the annotated version of the set of text from said input, said phrasing module generating a statistical representation, said statistical representation being a function of a set of structural information of the set of text and a set of intonational feature annotations of the annotated version of the set of text, said phrasing module storing said statistical representation for use in generating an intonational phrased output for future text input into the system.

26. An apparatus comprising:

a processor for generating structural information based on a set of text; and a phrasing module for generating a statistical representation based on said structural information and on a set of intonational feature annotations of an annotated version of said set of text, said phrasing module being operable to apply an input text to said statistical representation to generate a synthesized speech signal.

27. A method comprising the steps of:

generating structural information based on a set of text;

generating a statistical representation based on said structural information and on a set of intonational feature annotations of an annotated version of said set of text, and applying said statistical representation to a set of input text to generate a synthesized speech signal.

28. A machine implemented method of converting text to speech, said method comprising:

(a) accessing a stored statistical representation from a phrasing module, the stored statistical representation being a function of a set of predetermined text and intonational feature annotations therefor;

(b) applying a set of input text having a physically tangible readable form to the stored statistical representation to generate an output representative of the set of input text; and (c) post-processing the output to generate a synthesized speech signal.

29. An apparatus for performing text-to-speech conversion on a set of input text, said apparatus comprising:

a first processor, said first processor preprocessing a set of input text having a physically tangible readable form;

a phrasing module connected to said first processor, said phrasing module having said pre-processed input text as an input, said phrasing module including a stored statistical representation which is a function of a set of predetermined text and intonational feature annotations therefor, said phrasing module applying the set of pre-processed input text to the stored statistical representation to generate an output representative of the set of input text; and a second processor connected to said phrasing module, said second processor post-processing the output to generate a synthesized speech signal.

30. An apparatus for converting text to speech, said apparatus comprising:

an input for receiving a pre-processed set of input text; and a phrasing module receiving said set of preprocessed input text from said input, said phrasing module including a stored statistical representation which is a function of a set of predetermined text and intonational feature annotations therefor, said phrasing module applying said set of pre-processed input text to the stored statistical representation to generate an output representative of the set of input text.

* * * * *